US010677006B2

(12) United States Patent
von Gynz-Rekowski et al.

(10) Patent No.: US 10,677,006 B2
(45) Date of Patent: Jun. 9, 2020

(54) VIBRATION ASSEMBLY AND METHOD

(71) Applicant: Rival Downhole Tools LC, Houston, TX (US)

(72) Inventors: Gunther H H von Gynz-Rekowski, Montgomery, TX (US); Steven Samuel Mitchell, Scottsdale, AZ (US); Curtis E. Leitko, Jr., Round Top, TX (US); Russell Wayne Koenig, Conroe, TX (US); William Christian Herben, Magnolia, TX (US)

(73) Assignee: Rival Downhole Tools LC, Houston, TX (US)

( * ) Notice: Subject to any disclaimer, the term of this patent is extended or adjusted under 35 U.S.C. 154(b) by 321 days.

(21) Appl. No.: 15/816,281

(22) Filed: Nov. 17, 2017

(65) Prior Publication Data

US 2019/0153797 A1 May 23, 2019

(51) Int. Cl.

| | |
|---|---|
| ***E21B 28/00*** | (2006.01) |
| ***E21B 21/10*** | (2006.01) |
| ***E21B 7/24*** | (2006.01) |

(52) U.S. Cl.

CPC ..... *E21B 28/00* (2013.01); *E21B 7/24* (2013.01); *E21B 21/10* (2013.01)

(58) Field of Classification Search

CPC combination set(s) only.

See application file for complete search history.

(56) References Cited

U.S. PATENT DOCUMENTS

| | | | | |
|---|---|---|---|---|
| 2,003,281 A * | 6/1935 | Bijur | ..... | F16N 13/08 184/28 |
| 2,780,438 A | 2/1957 | Bielstein | | |
| 4,819,745 A | 4/1989 | Walter | | |

(Continued)

FOREIGN PATENT DOCUMENTS

| | | |
|---|---|---|
| AU | 2014902054 | 5/2014 |
| WO | 2016063131 | 4/2016 |

OTHER PUBLICATIONS

International Search Report and Written Opinion dated Jan. 18, 2019, from Applicant's counterpart International Patent Application No. PCT/US2018/51708.

(Continued)

*Primary Examiner* — Cathleen R Hutchins
*Assistant Examiner* — Ronald R Runyan
(74) *Attorney, Agent, or Firm* — Jones Walker LLP

(57) ABSTRACT

A downhole vibration assembly includes a valve positioned above a rotor that is disposed at least partially within a stator. The rotor is operatively suspended within an inner bore of a housing and configured to rotate within the stator as a fluid flows through the vibration assembly. The valve includes a rotating valve segment and a stationary valve segment each including at least one fluid passage. The rotating valve segment rotates with a rotation of the rotor. In an open position, the fluid passages of the valve segments are aligned and a fluid flows through the valve. In a restricted position, the fluid passages of the valve segments are partially or completely unaligned, thereby temporarily restricting the fluid flow through the valve to create a pressure pulse. The unobstructed pressure pulse is transmitted through the drill string or coiled tubing above the valve.

16 Claims, 7 Drawing Sheets

(56) References Cited

U.S. PATENT DOCUMENTS

| | | | | |
|---|---|---|---|---|
| 5,174,392 | A * | 12/1992 | Reinhardt | E21B 4/02 175/107 |
| 6,279,670 | B1 | 8/2001 | Eddison et al. | |
| 6,412,560 | B1 * | 7/2002 | Bernat | E21B 19/07 166/301 |
| 7,405,998 | B2 | 7/2008 | Webb et al. | |
| 8,162,078 | B2 | 8/2012 | Anderson | |
| 8,469,104 | B2 * | 6/2013 | Downton | E21B 4/02 166/330 |
| 9,091,123 | B2 | 7/2015 | Gust | |
| 9,273,529 | B2 | 3/2016 | Eddison et al. | |
| 9,637,976 | B2 | 5/2017 | Lorenson et al. | |
| 9,657,561 | B1 | 5/2017 | Bargach et al. | |
| 9,765,584 | B2 | 9/2017 | Lorenson et al. | |
| 2001/0054515 | A1 | 12/2001 | Eddison et al. | |
| 2011/0073374 | A1 | 3/2011 | Bunney et al. | |
| 2011/0217199 | A1 | 9/2011 | Groves | |
| 2013/0048386 | A1 | 2/2013 | Le et al. | |
| 2014/0041943 | A1 * | 2/2014 | Lanning | E21B 4/02 175/57 |
| 2014/0190749 | A1 | 7/2014 | Lorenson et al. | |
| 2014/0246240 | A1 | 9/2014 | Lorenson et al. | |
| 2015/0075867 | A1 | 3/2015 | Eddison et al. | |
| 2017/0204693 | A1 | 7/2017 | Von Gynz-Rekowski et al. | |

OTHER PUBLICATIONS

Impulse Downhole Tools, "Actipulse" brochure.
Trican Completion Solutions, Toe Tapper™ brochure.

* cited by examiner

VIBRATION ASSEMBLY AND METHOD

BACKGROUND OF THE INVENTION

In the drilling of oil and gas wells, a downhole drilling motor and a drill bit are attached to the end of a drill string. Most downhole drilling motors include a rotor rotating within a stator. The rotation of the rotor provides a vibration to the adjacent drill bit as it cuts through the subterranean formation to drill the wellbore. The drill string slides through the higher portions of the wellbore as the drill bit at the end of the drill string extends the wellbore deeper into the formation. A vibration tool is sometimes attached to the drill string a distance above the drill bit (e.g., 800-1,500 feet above the drill bit). The vibration tool provides vibration to the portions of the drill string above the vibration tool, thereby facilitating the movement of the drill string through the wellbore.

Conventional vibration tools include a power section made of a rotor rotating within a stator and a valve positioned below the rotor. As the rotor rotates, the valve periodically restricts fluid flow through the vibration tool, which creates a pressure pulse or waterhammer that is transmitted through the power section and up through the portion of the drill string above the vibration tool.

DETAILED DESCRIPTION OF THE PREFERRED EMBODIMENTS

Figure 9:
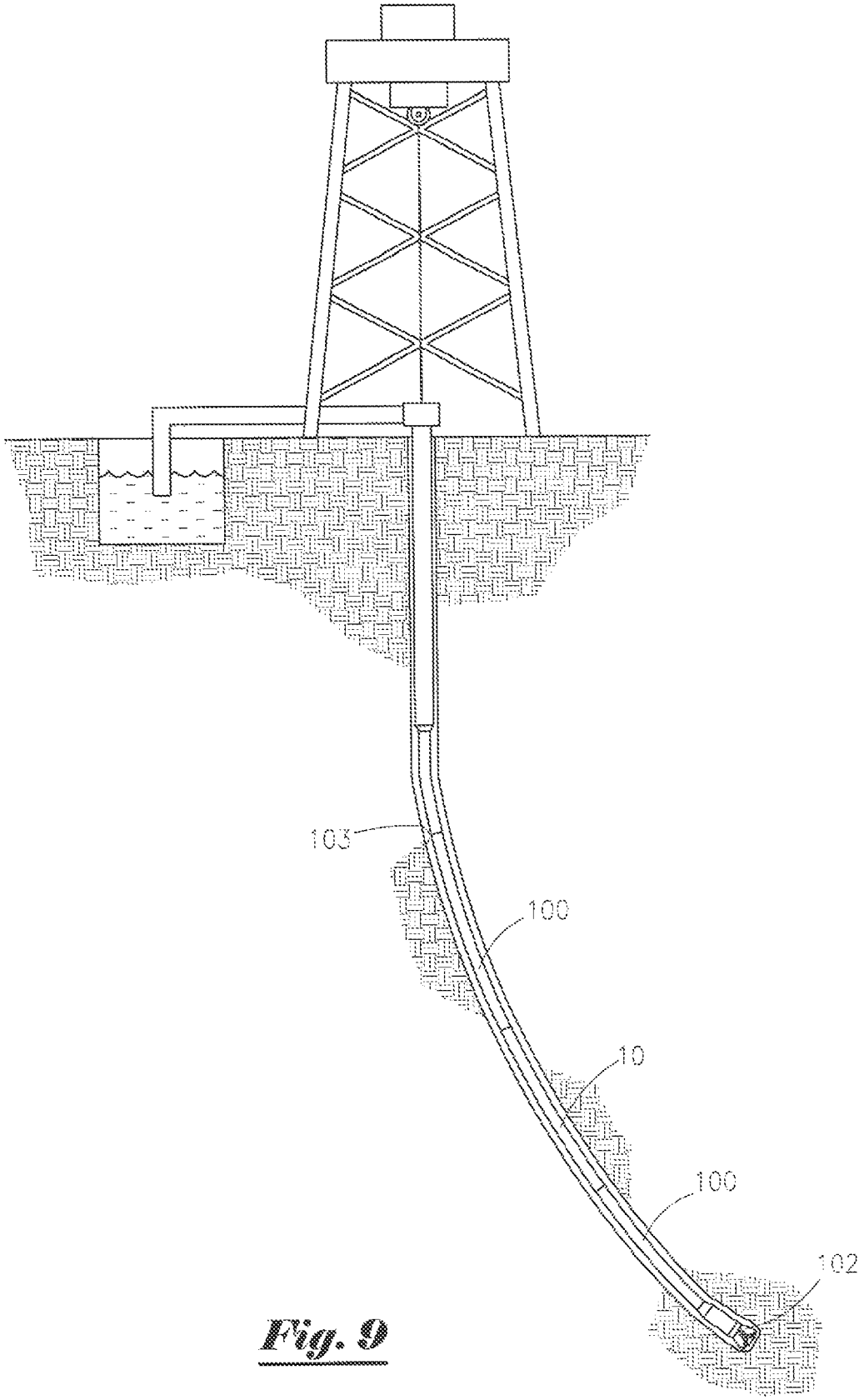
FIG. 9 is a schematic view, partially in cross-section, of the vibration assembly positioned on a drill string or coiled tubing line.

A vibration assembly 10 of the present disclosure may be attached to a drill string 100 and lowered into a wellbore 103 (See, FIG. 9). Drill bit 102 is positioned at the end of drill string 100. The vibration assembly may include a valve positioned above a power section. The power section may be a positive displacement power section, a turbine, or any other hydraulic motor mechanism for generating torque with a fluid flow. In one embodiment, the power section is a positive displacement power section including a rotor disposed at least partially within a stator. The rotor is configured to rotate within the stator as a fluid flows through the vibration assembly. The valve may include a rotating valve segment and a stationary valve segment each including at least one fluid passage. The rotating valve segment is configured to rotate with rotation of the rotor, while the stationary valve segment remains fixed (i.e., does not rotate).

In an open position, the fluid passage of the rotating valve segment is aligned with the fluid passage of the stationary valve segment, and the fluid flows through these fluid passages of the valve. In a restricted position, the fluid passage of the rotating valve segment is not aligned with a fluid passage in the stationary valve segment (e.g., at least partially unaligned), thereby temporarily restricting the fluid flow through the valve. The flow restriction creates a pressure pulse or waterhammer that is transmitted upstream thereby stretching and retracting a drill string or coiled tubing line 100 (see, FIG. 9) above the vibration assembly. Because the valve is positioned above the power section, the vibration assembly of the present disclosure transmits a pressure pulse to the drill string above more efficiently than conventional vibration tools. In certain embodiments, the vibration assembly may also include a shock assembly disposed at an upper end of the vibration assembly. When present, the shock assembly facilitates relative axial movement of the drill string 100 above the vibration assembly relative to the drill string below the vibration assembly thereby vibrating the drill string 100 above the vibration assembly.

In some embodiments, a flex shaft or stiff cable may interconnect the valve and the power section. An upper end of the flex shaft or cable may be attached to the rotating valve segment, and a lower end of the flex shaft or cable may be attached to the rotor. In this way, the flex shaft or cable transmits torque from the rotor to the rotating valve segment to rotate the rotating valve segment with the rotation of the rotor.

Figure 1A:
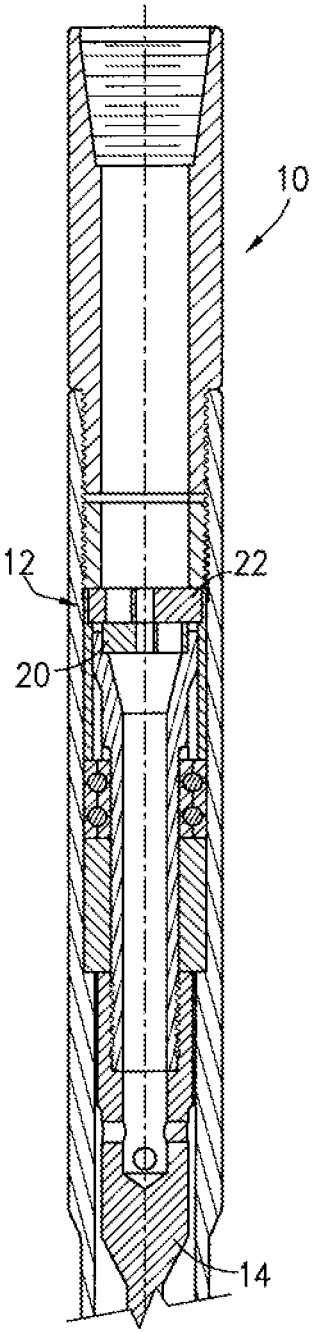
FIGS. 1A-1B are a cross-sectional view of a vibration assembly.
Figure 1B:
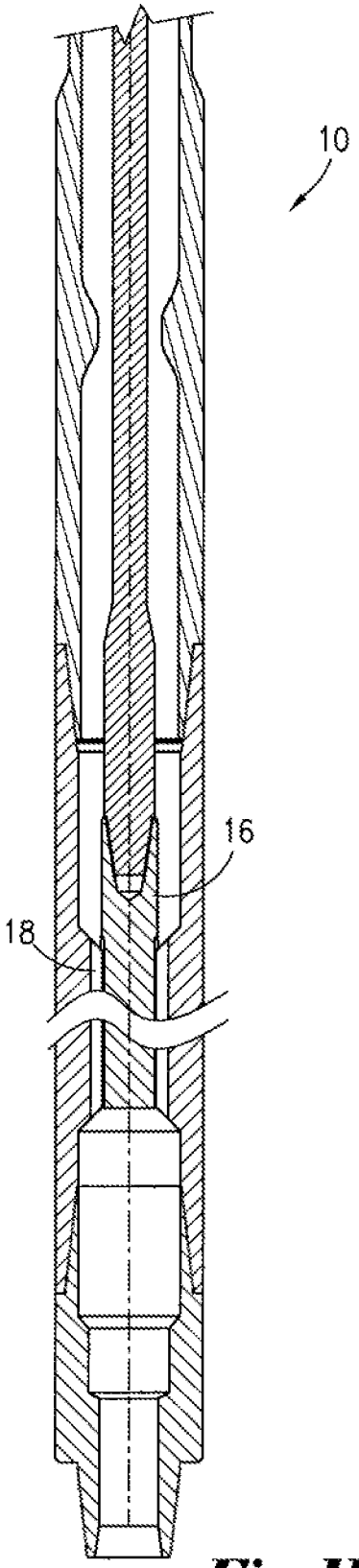

FIGS. 1A-1B illustrate one embodiment of the vibration assembly of the present disclosure. Vibration assembly 10 includes valve 12, flex shaft 14 attached to a lower end of valve 12, rotor 16 attached to a lower end of flex shaft 14, and stator 18 disposed at least partially around rotor 16. Valve 12 includes rotating valve segment 20 and stationary valve segment 22. In this embodiment, rotating valve segment 20 is positioned below stationary valve segment 22, but other embodiments may include rotating valve segment 20 positioned above stationary valve segment 22. Vibration assembly 10 may also include one or more tubular housing segments having an inner bore, with valve 12, flex shaft 14, rotor 16, and stator 18 disposed within the inner bore.

Figure 3:
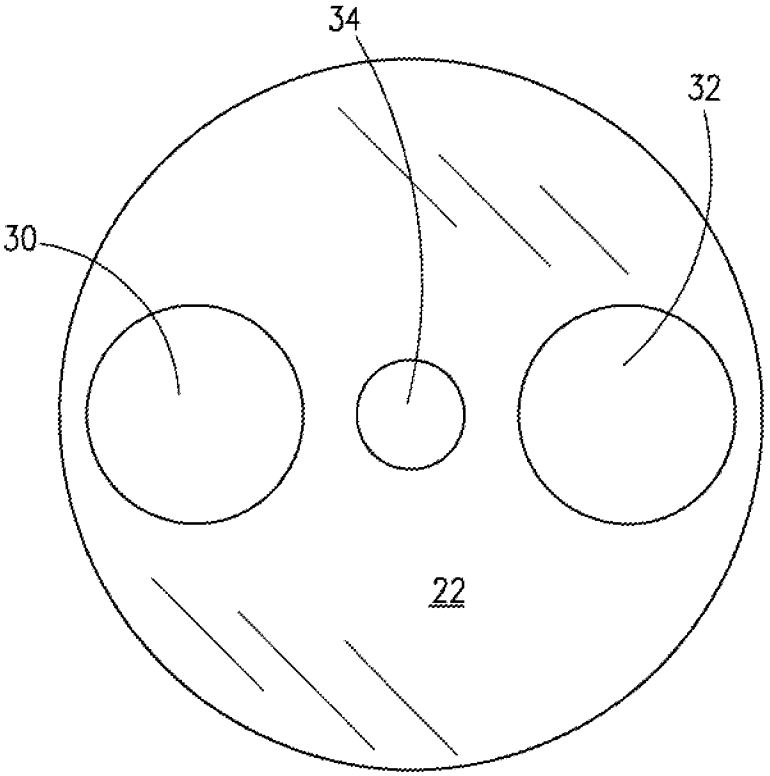
FIG. 3 is a top view of a stationary valve segment of the vibration assembly.
Figure 2:
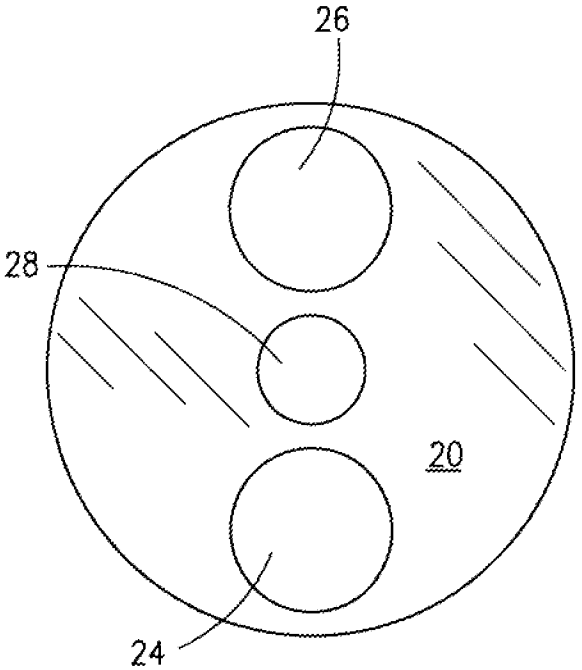
FIG. 2 is a top view of a rotating valve segment of the vibration assembly.

With reference to FIGS. 2 and 3, rotating valve segment 20 may be formed of a plate or disc including fluid passages 24 and 26 and central passage 28. Stationary valve segment 22 may be formed of a plate or disc including fluid passages 30 and 32 and central passage 34. In an open position, passages 24, 26 of rotating valve segment 20 are at least partially aligned with passages 30, 32 of stationary valve segment 22 to allow a fluid to flow through valve 12. The fluid flow may be temporarily restricted when passages 24, 26 of rotating valve segment 20 are not aligned with passages 30, 32 of stationary valve segment 22. In this restricted position, the fluid flows through central passages 28, 34 of rotating valve segment 20 and stationary valve segment 22, respectively, to guarantee a minimum fluid flow to drive rotor 16 in stator 18.

In other embodiments, rotating and stationary valve segments 20, 22 include no central passages. Instead, the fluid passages of valve segments 20, 22 are arranged such that at least one fluid passage of rotating valve segment 20 is partially aligned with a fluid passage of stationary valve segment 22 in the restricted position to guarantee a minimum fluid flow to drive rotor 16 in stator 18.

Figure 4A:
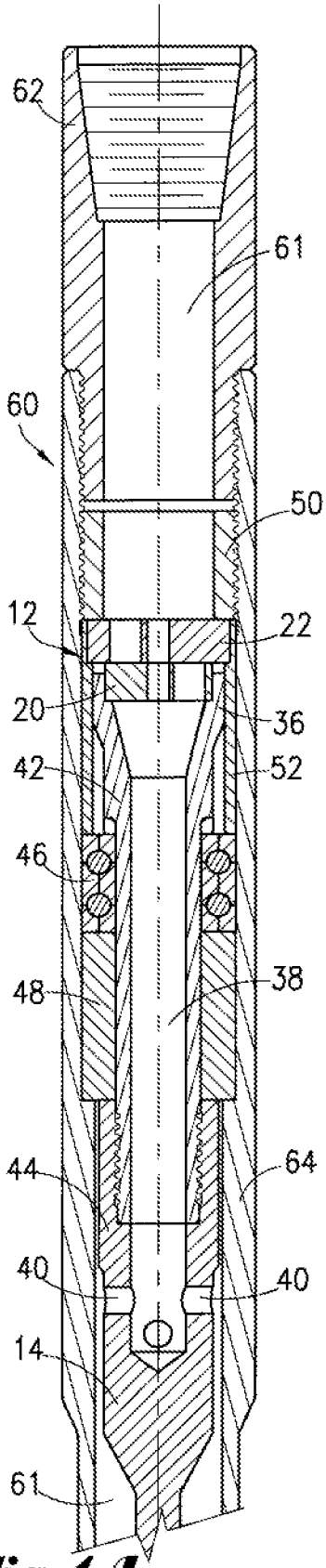
FIGS. 4A-4C are another cross-sectional view of the vibration assembly.
Figure 4B:
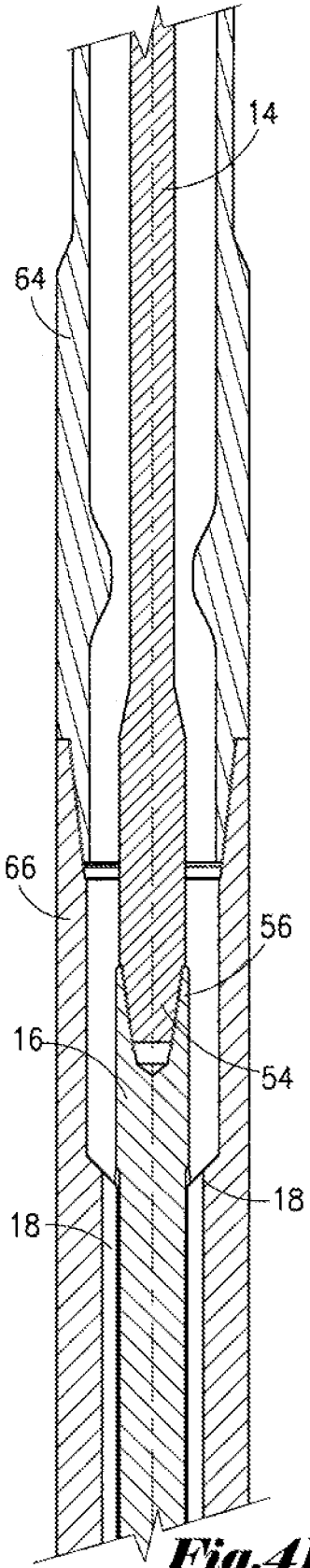
Figure 4C:
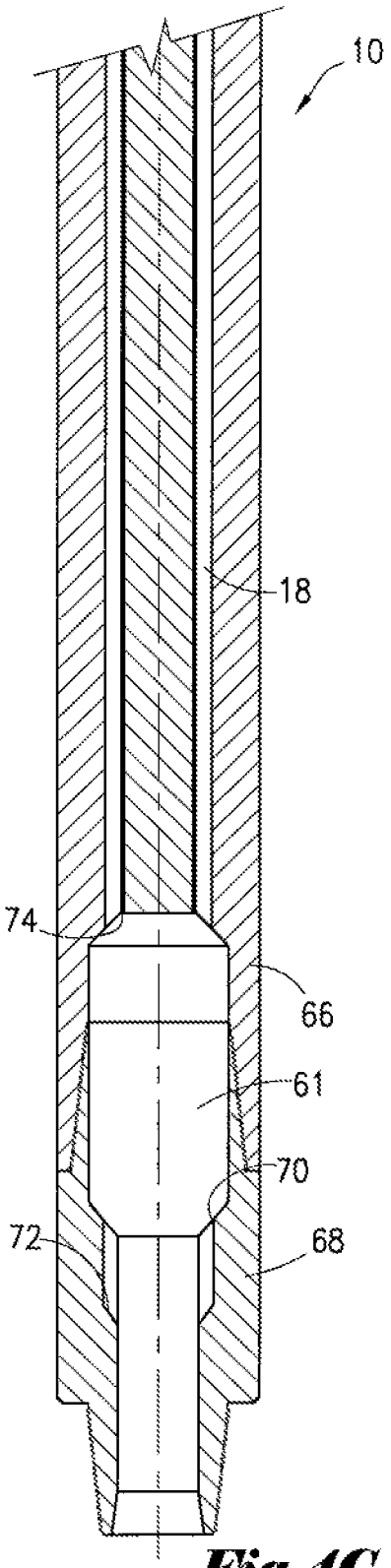
Figure 5A:
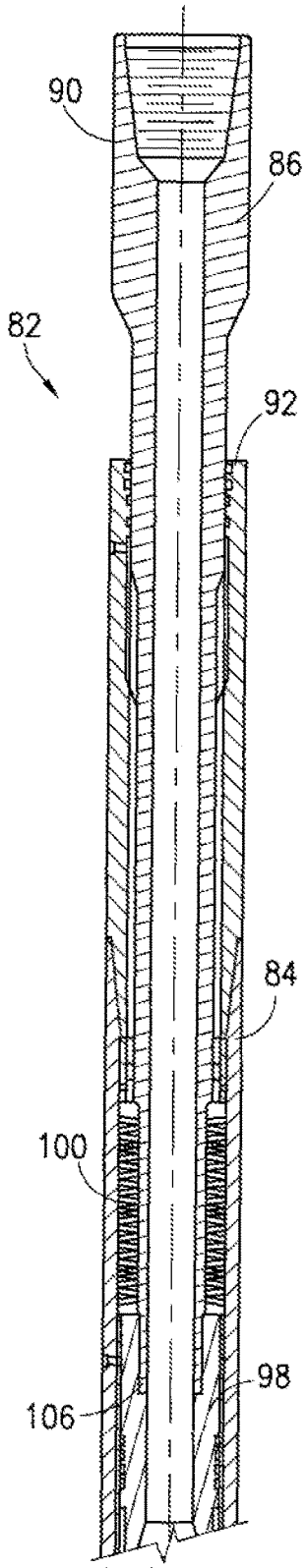
FIGS. 5A-5D are a cross-sectional view of the vibration assembly including a shock assembly.
Figure 5B:
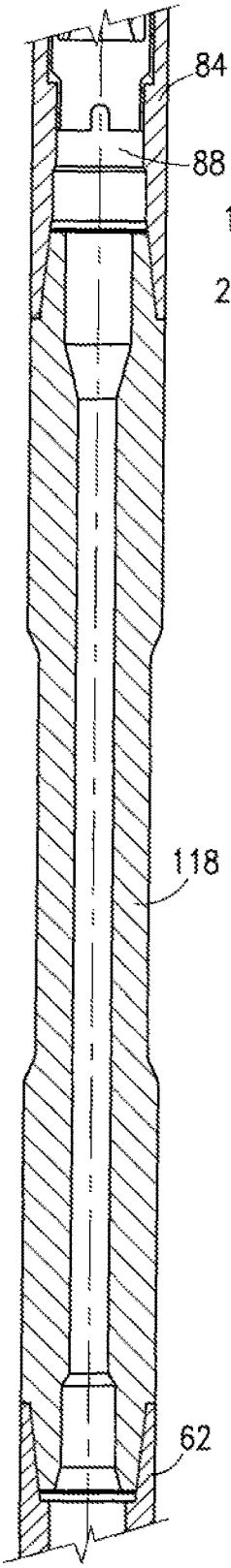
Figure 5C:
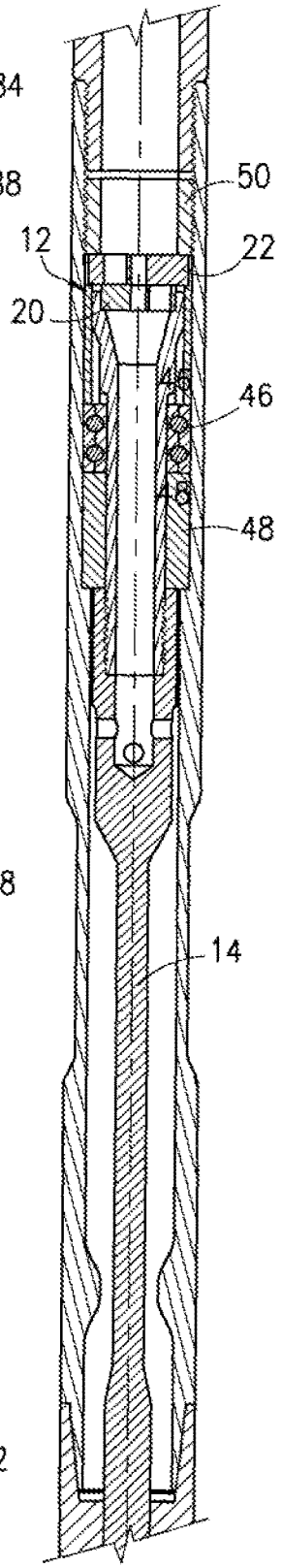
Figure 5D:
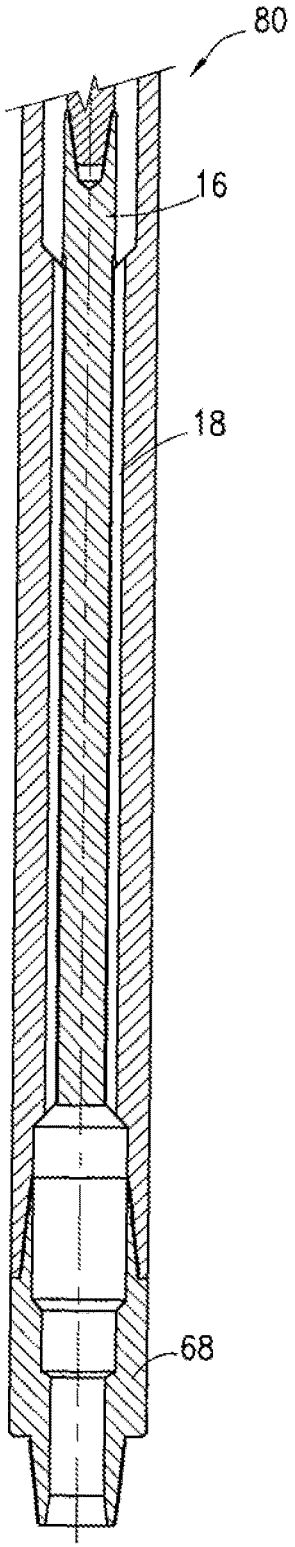

Referring now to FIGS. 4A-4C, rotating valve segment 20 is secured to upper end 36 of flex shaft 14 such that rotating valve segment 20 rotates with flex shaft 14. Central bore 38 of flex shaft 14 extends from upper end 36 to fluid passages 40. Flex shaft 14 may include any number of fluid passages 40 to support the fluid flow through central bore 38. The upper portion of flex shaft 14 surrounding central bore 38 may be formed of two or more segments, such as segments 42, 44. Thrust bearings 46 and radial bearings 48 may be disposed around segment 42, and radial bearings 48 may abut an upper end of segment 44. Stationary valve segment 22 is disposed between rotating valve segment 20 and nut 50. Compression sleeve 52 may be disposed around stationary valve segment 22 and segment 42 of the upper portion of flex shaft 14. An upper end of compression sleeve 52 may abut a lower end of nut 50. Stationary valve segment 22 may be maintained in a non-rotating and stationary position by nut 50. Radial bearings 48 may be maintained by compression sleeve 52 and nut 50. Below fluid passages 40, flex shaft 14 may be formed of a rod or bar of sufficient length to provide flexibility for offsetting the eccentric motion of a multi-lobe rotor. Lower end 54 of flex shaft 14 may be secured to upper end 56 of rotor 16. In one embodiment, flex shaft 14 and rotor 16 may be threadedly connected. In this way, rotor 16 is suspended within stator 18 by flex shaft 14.

Housing 60 may include inner bore 61. Housing 60 may be formed of housing segments 62, 64, 66, and 68, each including an inner bore. Nut 50 may be threadedly connected to the inner bore of housing segment 64. Radial bearings 48 may engage a shoulder of housing segment 64 to support thrust bearings 46, compression sleeve 52, and stationary valve segment 22, thereby operatively suspending flex shaft 14 and rotor 16 within inner bore 61 of housing 60. Stator 18 may be secured within the inner bore of housing segment 66. Housing segment 68 may include safety shoulder 70 designed to catch rotor 16 if rotor 16 is disconnected from flex shaft 14 or if flex shaft 14 is disconnected from housing segment 64. Housing segment 68 may further include fluid bypass 72 to allow a fluid flow through inner bore 61 if rotor 16 engages safety shoulder 70.

Referring still to FIGS. 4A-4C. vibration assembly 10 may be secured within a drill string by threadedly connecting housing segment 62 to a first drill string segment and connecting housing segment 68 to a second drill string segment. A fluid may be pumped through an inner bore of the first drill string segment and into inner bore 61 of housing 60. With valve 12 in the open position, the fluid may flow through fluid passages 30, 32 of stationary valve segment 22 and fluid passages 24, 26 of rotating valve segment 20. The fluid flow may continue into central bore 38 of flex shaft 14 and out through fluid passages 40 of flex shaft 14 to return to inner bore 61 of housing 60. The fluid may flow around flex shaft 14 in inner bore 61 of housing 60 and around upper end 56 of rotor 16. Rotor 16 includes a number of lobes that correlate with a certain number of cavities of stator 18. When the fluid reaches stator 18, the fluid flows through the cavities between stator 18 and rotor 16. This fluid flow causes rotor 16 to rotate within stator 18. In this way, rotor 16 and stator 18 form a positive displacement power section. The fluid flow exits at lower end 74 of stator 18 to return to inner bore 61 of housing 60 and continue flowing into an inner bore of the second drill string segment below vibration assembly 10.

As the fluid flow through stator 18 rotates rotor 16, flex shaft 14 and rotating valve segment 20 are rotated as torque is transmitted to these elements. Rotating valve segment 20 rotates relative to stationary valve segment 22, which cycles valve 12 between the open position and the restricted position in which fluid flow is limited to central passages 28, 34 of rotating and stationary valve segments 20, 22. The fluid flow restriction generates a pressure pulse or water-hammer that is transmitted upstream to the drill string above vibration assembly 10. The repeated pressure pulse generation causes a stretching and retracting in the drill string above vibration assembly 10, thereby facilitating vibration and easing the movement of the drill string through a wellbore. The vibration may reduce friction between an outer surface of the drill string and an inner surface of the wellbore.

In an alternate embodiment, the power section is formed of a turbine or any other hydraulic motor mechanism for generating torque with a fluid flow. The power section includes at least one rotor element configured to rotate with the fluid flow through the power section. The rotor element is operatively connected to the rotating valve segment, such that the rotating valve segment rotates with a rotation of the rotor.

FIGS. 5A-5D illustrate another alternate embodiment of the vibration assembly of the present disclosure. Vibration assembly 80 includes the same features described above in connection with vibration assembly 10, with the same reference numbers indicating the same structure and function described above. Vibration assembly 80 further includes an integrally formed shock assembly 82 designed to facilitate axial movement in the adjacent drill string with the pressure pulse transmitted by vibration assembly 80. In other embodiments, a separate shock assembly may be placed above the vibration assembly. In still other embodiments (as illustrated in FIGS. 1A-4C), the vibration assembly may function without a shock assembly, such as applications in which the vibration assembly is used with coiled tubing.

In the embodiment illustrated in FIGS. 5A-5D, shock assembly 82 may include first sub 84 and mandrel 86 at least partially slidingly disposed within inner bore 88 of first sub 84. Upper end 90 of mandrel 86 extends above upper end 92 of first sub 84. Shock assembly 82 may also include piston 98 and spring 100. Piston 98 may be threadedly secured to lower end 106 of mandrel 86. Spring 100 is disposed around mandrel 86 and within inner bore 88 of first sub 84. Spring 100 is configured to be compressed with axial movement of mandrel 86 relative to first sub 84 in both directions. Shock assembly 82 may further include flex sub 118. A lower end of flex sub 118 may be secured to the upper end of housing segment 62 above valve 12. In this way, shock assembly 82 is disposed above housing 60. An upper end of flex sub 118 may be secured to a lower end of first sub 84 of shock assembly 82. An upper end 90 of mandrel 86 of shock assembly 82 may be secured to a drill string segment to position vibration assembly 80 in the drill string. A pressure pulse generated by valve 12 may cause mandrel 86 to move relative to first sub 84 in two directions along an axis (i.e., in both axial directions).

Figure 6A:
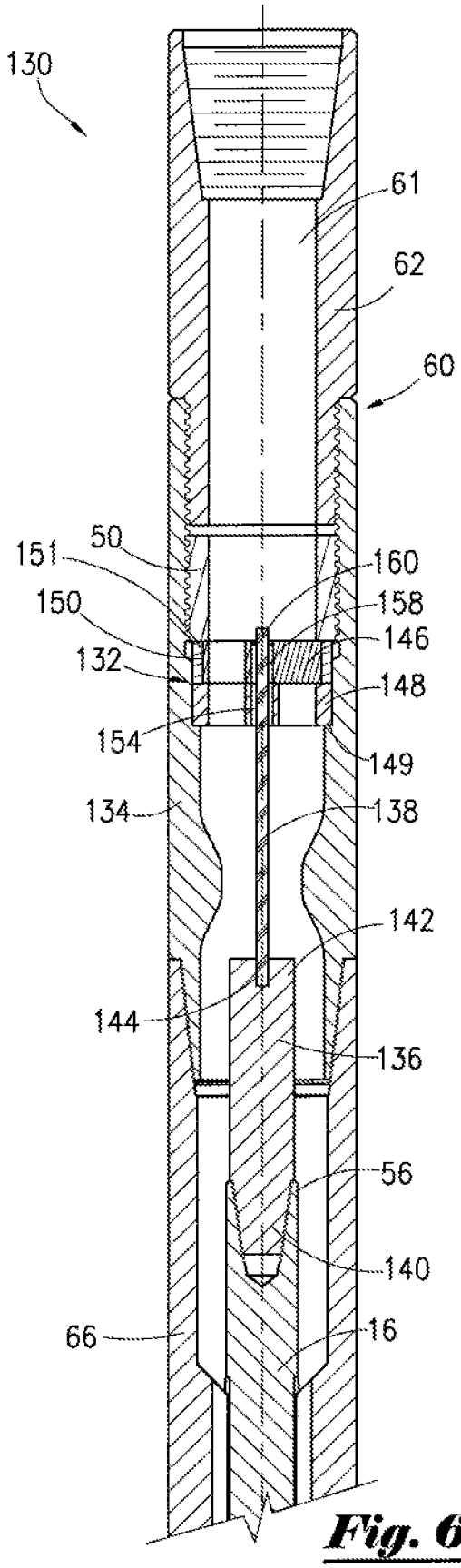
FIGS. 6A-6B are a cross-sectional view of an alternate embodiment of the vibration assembly.
Figure 6B:
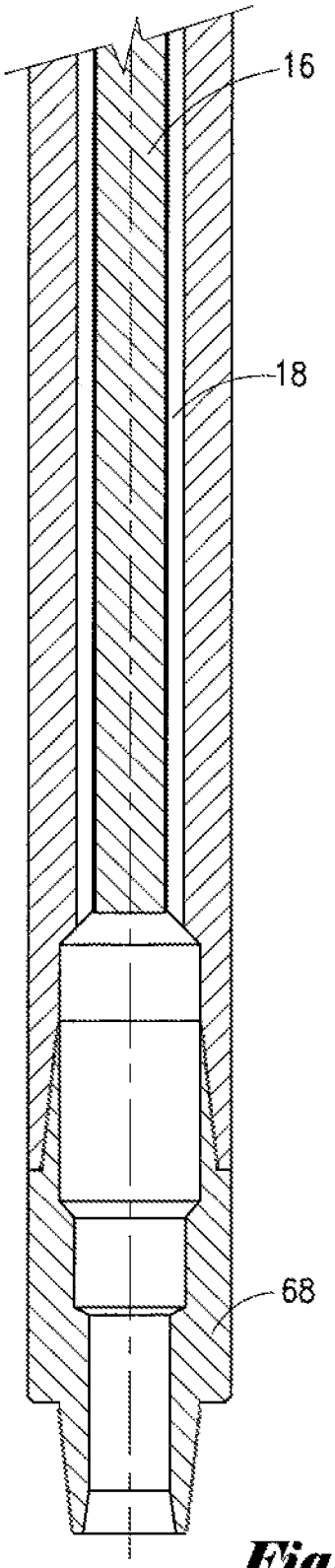

FIGS. 6A-6B illustrate another alternate embodiment of the vibration assembly of the present disclosure, with the same reference numbers indicating the same structure and function described above. Vibration assembly 130 includes valve 132 disposed above rotor 16 and stator 18 all disposed within inner bore 61 of housing 60, which includes housing segments 62, 134, 66, and 68. Vibration assembly 130 also includes adapter 136 and flex line 138 interconnecting valve 132 and rotor 16. Lower end 140 of adapter 136 is secured to upper end 56 of rotor 16, and upper end 142 of adapter 136 is secured to lower end 144 of flex line 138. Valve 132 may include rotating valve segment 146 and stationary valve segment 148. Stationary valve segment 148 may engage and be supported by inner shoulder 149 of housing segment 134.

Rotating valve segment 146 may be positioned above stationary valve segment 148 and below nut 50, which is threadedly connected to a surface of the inner bore of housing segment 134. In this way, rotor 16 is suspended within inner bore 61 of housing 60 and within stator 18 by adapter 136, flex line 138, and rotating valve segment 146. Outer surface 150 of rotating valve segment 146 is radially guided by radial sleeve 151. An upper end of radial sleeve 151 abuts a lower end of nut 50, and a lower end of radial sleeve 151 abuts an upper end of stationary valve segment 148. Stationary valve segment 148 may be maintained in a non-rotating and stationary position by a compression force applied by nut 50 through radial sleeve 151.

Figure 8:
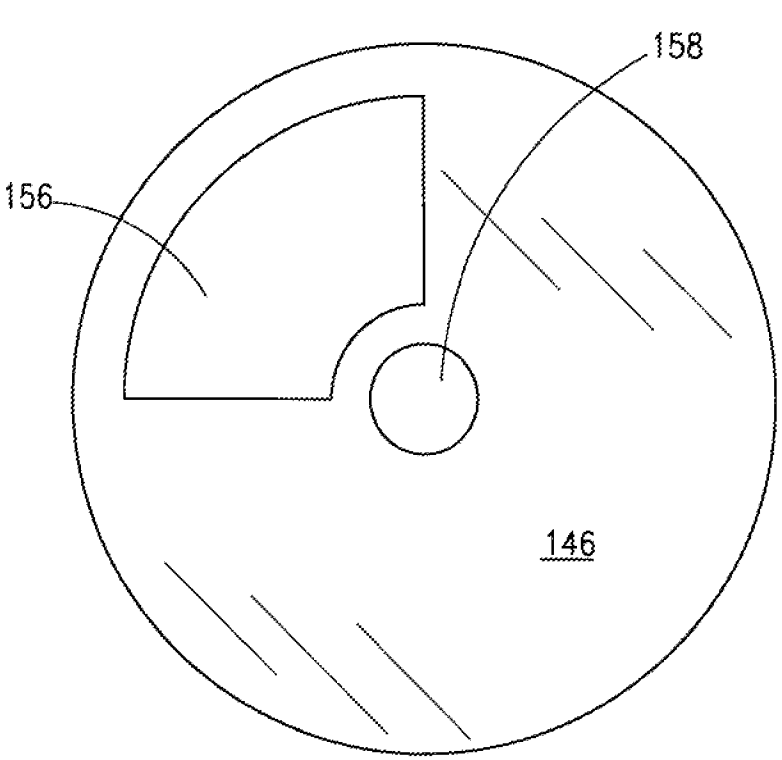
FIG. 8 is a top view of a rotating valve segment of the vibration assembly of FIGS. 6A-6B.
Figure 7:
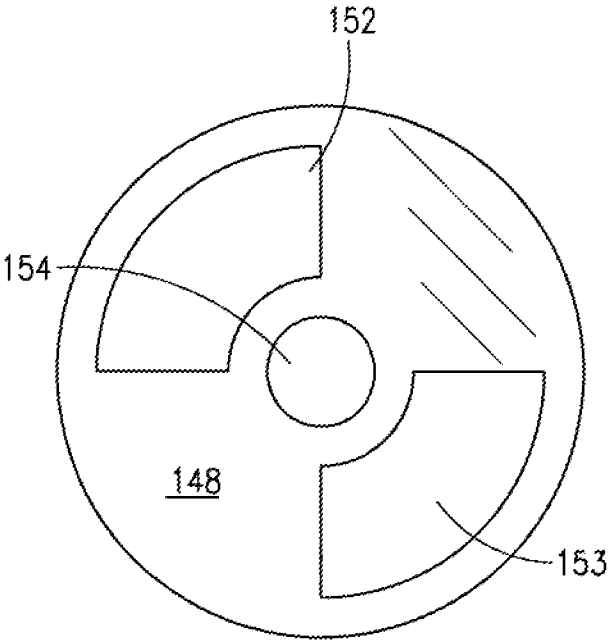
FIG. 7 is a top view of a stationary valve segment of the vibration assembly of FIGS. 6A-6B.

Referring now to FIGS. 7 and 8, stationary valve segment 148 may be formed of a plate or disc including fluid passages 152 and 153 and central aperture 154. Rotating valve segment 146 may be formed of a plate or disc including fluid passage 156 and central aperture 158. In an open position, passage 156 of rotating valve segment 146 is at least partially aligned with passage 152 or passage 153 of stationary valve segment 148 to allow a fluid to flow through valve 132. In a restricted position, passage 156 of rotating valve segment 146 is unaligned (at least partially) with passages 152, 153 of stationary valve segment 148.

With reference again to FIGS. 6A-6B, flex line 138 is disposed through central aperture 154 of stationary valve segment 148. Upper end 160 of flex line 138 is secured to central aperture 158 of rotating valve segment 146. Due to the pressure drop generated by rotor 16, flex line 138 is in tension and stationary valve segment 148 functions as a thrust bearing acting against rotating valve segment 146. Flex line 138 may be formed of a cable, rope, rod, chain, or any other structure having a stiffness sufficient to transmit torque between adapter 136 and rotating valve segment 146. For example, flex line 138 may be formed of a steel rope or cable. Flex line 138 may be secured to central aperture 158 by clamping, braising, wedging, with fixed bolts, or any other suitable means. Rotation of rotor 16 may rotate adapter 136, flex line 138, and rotating valve segment 146. The suspended arrangement of rotor 16 within inner bore 61 of housing 62 allows for the use of flex line 138 between shaft 16 and valve 132 (instead of a rigid flex shaft), which reduces the overall length and weight of vibration assembly 130 over conventional vibration tools.

Vibration assembly 130 may be secured within a drill string by threadedly connecting housing segment 62 to a first drill string segment and connecting housing segment 68 to a second drill string segment. A fluid may be pumped through an inner bore of the first drill string segment and into inner bore 61 of housing 60. With valve 132 in the open position, the fluid may flow through fluid passage 156 of rotating valve segment 146 and fluid passage 152 or 153 of stationary valve segment 148. The fluid flow may continue into inner bore 61 of housing 60 around flex line 138, around adapter 135, and around upper end 56 of rotor 16. As the fluid flow through stator 18 rotates rotor 16 (as described above), adapter 136, flex line 138, and rotating valve segment 146 are rotated as torque is transmitted to these elements. Rotating valve segment 146 rotates relative to stationary valve segment 148, which cycles valve 132 between the open position and the restricted position in which fluid flow through valve 132 is restricted. The fluid flow restriction generates a pressure pulse or waterhammer that is transmitted upstream to the drill string above vibration assembly 130. The repeated pressure pulse generation causes a stretching and retracting of the drill string initiating vibration in the drill string above vibration assembly 130, thereby facilitating and easing the movement of the drill string through a wellbore. The vibration may reduce friction between an outer surface of the drill string and an inner surface of the wellbore.

In one embodiment, vibration assembly 130 further includes a shock assembly, such as shock assembly 82. The shock assembly facilitates axial movement (in both directions) of the drill string above vibration assembly 130 relative to the drill string below vibration assembly 130.

In conventional vibration tools, a valve is positioned below a positive displacement power section. A pressure pulse generated in the valve of conventional vibration tools must be transmitted through the positive displacement power section before being transmitted to the drill string above. Because power sections are designed to convert hydraulic energy into mechanical energy, the positive displacement power sections of conventional vibration tools use a portion of the hydraulic energy of the pressure pulse generated by the valve below by converting an amount of the hydraulic energy into mechanical energy to overcome friction between the rotor and the stator, which is defined by the mechanical efficiency of the positive displacement power section itself. Additionally, the rubber or other flexible material of the stator in conventional vibration tools is compressed when in contact with the rotor, which dampens the magnitude of the pressure pulse as the pressure pulse is forced to travel through the positive displacement power section before being transmitted to the drill string above.

In the vibration assembly of the present disclosure, a valve is disposed above a power section. The pressure pulse generated by the valve is transmitted to the drill string above without traveling across the power section. In other words, the vibration assembly of the present disclosure transmits an unobstructed pressure pulse or waterhammer to the drill string or coiled tubing above. Accordingly, the vibration assembly of the present disclosure transmits the pressure pulse or waterhammer and vibration energy to the drill string above more efficiently than conventional vibration tools.

As used herein, "above" and any other indication of a greater height or latitude shall also mean upstream, and "below" and any other indication of a lesser height or latitude shall also mean downstream. As used herein, "drill string" shall include a series of drill string segments and a coiled tubing line.

While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

The invention claimed is:

1. A downhole vibration assembly for transmitting a pressure pulse in a drill string above a drill bit, comprising:

a positive displacement power section disposed in an inner bore of a housing, the positive displacement power section including a rotor disposed at least partially within a stator, wherein the rotor is operatively suspended within the inner bore of the housing to rotate within the stator upon a fluid flow through the positive displacement power section;

a valve disposed above the positive displacement power section within the inner bore of the housing, the valve including a rotating valve segment and a stationary valve segment each including at least one fluid passage, wherein the rotating valve segment is configured to rotate with a rotation of the rotor for cycling the valve between an open position and a restricted position, wherein in the open position the fluid passage of the rotating valve segment is aligned with the fluid passage of the stationary valve segment, wherein in the restricted position the fluid passage of the rotating valve segment is at least partially unaligned with the fluid passage of the stationary valve segment for restricting the fluid flow through the valve to generate and transmit an unobstructed pressure pulse through the drill string above the valve;

a nut threadedly secured to a surface of the inner bore of the housing, wherein the nut is disposed above the stationary valve segment and abuts an upper surface of the stationary valve segment; and a compression sleeve disposed between the stationary valve segment and the surface of the inner bore of the housing, wherein an upper end of the compression sleeve abuts the nut.

2. The downhole vibration assembly of claim 1, wherein the rotating valve segment and the stationary valve segment each includes a central passage, and wherein in the restricted position the fluid passage of the rotating valve segment is completely unaligned with the fluid passage of the stationary valve segment and the fluid flow travels through the central passages of the rotating valve segment and the stationary valve segment.

3. The downhole vibration assembly of claim 1, wherein the stationary valve segment is secured to the housing to prevent rotation of the stationary valve segment relative to the housing.

4. The downhole vibration assembly of claim 1, further comprising a flex shaft interconnecting the valve and the rotor, wherein the rotating valve segment is secured to an upper end of the flex shaft, wherein an upper end of the rotor is secured to a lower end of the flex shaft to operatively suspend the flex shaft and the rotor in the inner bore of the housing, and wherein the flex shaft and the rotating valve segment each rotates with the rotation of the rotor.

5. The downhole vibration assembly of claim 4, further comprising a thrust bearing and a radial bearing disposed within the inner bore of the housing and disposed around the flex shaft.

6. The downhole vibration assembly of claim 4, wherein the flex shaft includes an inner bore extending from the upper end of the flex shaft to one or more fluid passages extending from the inner bore of the flex shaft to an outer surface of the flex shaft.

7. The downhole vibration assembly of claim 1, further comprising:

an adapter secured to an upper end of the rotor within the inner bore of the housing; and a flex line interconnecting the valve and the adapter within the inner bore of the housing, wherein a lower end of the flex line is affixed to an upper end of the adapter, wherein the flex line is disposed through a central aperture of the stationary valve segment, and wherein an upper end of the flex line is secured to a central aperture of the rotating valve segment to operatively suspend the flex line, the adapter, and the rotor from the rotating valve segment in the inner bore of the housing, and wherein the adapter, the flex line, and the rotating valve segment each rotates with the rotation of the rotor.

8. The downhole vibration assembly of claim 7, wherein the flex line is formed of a rod, a rope, a chain, or a cable.

9. A downhole vibration assembly for transmitting a pressure pulse in a drill string above a drill bit, comprising:

a power section disposed in an inner bore of a housing, the power section including at least one rotor element operatively suspended within the inner bore of the housing to rotate upon a fluid flow through the power section; and a valve disposed above the power section within the inner bore of the housing, the valve including a rotating valve segment and a stationary valve segment each including at least one fluid passage, wherein the rotating valve segment is configured to rotate with a rotation of the rotor for cycling the valve between an open position and a restricted position, wherein in the open position the fluid passage of the rotating valve segment is aligned with the fluid passage of the stationary valve segment, wherein in the restricted position the fluid passage of the rotating valve segment is at least partially unaligned with the fluid passage of the stationary valve segment for restricting the fluid flow through the valve to generate and transmit an unobstructed pressure pulse through the drill string above the valve; and a shock assembly, the shock assembly comprising:

a first sub operatively connected to an upper end of the housing, the first sub including an inner bore;

a mandrel at least partially slidingly disposed within the inner bore of the first sub and extending beyond an upper end of the first sub; and a spring disposed between the outer surface of the mandrel and a surface of the inner bore of the first sub, wherein the spring is compressed by an axial movement of the mandrel relative to the first sub.

10. The downhole vibration assembly of claim 9, further comprising a flex sub secured between the upper end of the housing and a lower end of the first sub of the shock assembly.

11. A method of transmitting a vibration to a drill string above a drill bit, comprising the steps of:

a) providing a downhole vibration assembly comprising: a positive displacement power section disposed in an inner bore of a housing, the positive displacement power section including a rotor disposed at least partially within a stator, wherein the rotor is operatively suspended within the inner bore of the housing to rotate within the stator upon a fluid flow through the positive displacement power section; and a valve disposed above the positive displacement power section within the inner bore of the housing, the valve including a rotating valve segment and a stationary valve segment each including at least one fluid passage, wherein the rotating valve segment is configured to rotate with a rotation of the rotor for cycling the valve between an open position and a restricted position, wherein in the open position the fluid passage of the rotating valve segment is aligned with the fluid passage of the stationary valve segment, and wherein in the restricted position the fluid passage of the rotating valve segment is at least partially unaligned with the fluid passage of the stationary valve segment for restricting the fluid flow through the valve; a nut threadedly secured to a surface of the inner bore of the housing, wherein the nut is disposed above the stationary valve segment and abuts an upper surface of the stationary valve segment; and a compression sleeve disposed between the stationary valve segment and the surface of the inner bore of the housing, wherein an upper end of the compression sleeve abuts the nut;

b) securing the downhole vibration assembly between two segments of a drill string or on a coiled tubing line;

c) lowering the drill string or coiled tubing line with the downhole vibration assembly into a wellbore;

d) pumping a fluid through the drill string or coiled tubing line and through the downhole vibration assembly to rotate the rotor and the rotating valve segment for cycling the valve between the open position and the restricted position, wherein a pressure pulse is generated by the restriction of the fluid flow each time the valve is in the restricted position, and wherein the generated pressure pulses generate a stretching and retracting of the drill string or coiled tubing line initiating a vibration; and e) transmitting the vibration to the drill string or coiled tubing line above the downhole vibration assembly without the pressure pulse traveling through the positive displacement power section.

12. The method of claim 11, wherein step (b) further comprises securing an upper end of the housing to a first segment of the drill string and securing a lower end of the housing to a second segment of the drill string.

13. The method of claim 11, wherein step (b) further comprises securing an upper end of the housing to the coiled tubing line.

14. The method of claim 11, wherein in step (a) the downhole vibration assembly further comprises a flex shaft interconnecting the valve and the rotor, wherein the rotating valve segment is secured to an upper end of the flex shaft, and wherein an upper end of the rotor is secured to a lower end of the flex shaft to operatively suspend the flex shaft and the rotor in the inner bore of the housing; and wherein step (d) further comprises rotating the flex shaft with the rotation of the rotor and rotating the rotating valve segment with the rotation of the flex shaft.

15. The method of claim 11, wherein in step (a) the downhole vibration assembly further comprises an adapter secured to an upper end of the rotor within the inner bore of the housing; and a flex line interconnecting the valve and the adapter within the inner bore of the housing, wherein a lower end of the flex line is affixed to an upper end of the adapter, wherein the flex line is disposed through a central aperture of the stationary valve segment, and wherein an upper end of the flex line is secured to a central aperture of the rotating valve segment to operatively suspend the flex line, the adapter, and the rotor from the rotating valve segment in the inner bore of the housing; and wherein step (d) further comprises rotating the adapter with the rotation of the rotor, rotating the flex line with the rotation of the adapter, and rotating the rotating valve segment with the rotation of the flex line.

16. The method of claim 11, wherein in step (a) the downhole vibration assembly further comprises a shock assembly; and wherein step (d) further comprises: the generated pressure pulses axially activating the shock assembly to generate the vibration.

* * * * *